United States Patent [19]

Regan et al.

[11] 3,996,997

[45] Dec. 14, 1976

[54] TIGHTENING OF HEATING ELEMENTS OF A REGENERATIVE AIR HEATER

[75] Inventors: John William Regan, Windsor; Robert Leo Olson, Enfield, both of Conn.

[73] Assignee: Combustion Engineering, Inc., Windsor, Conn.

[22] Filed: Dec. 22, 1975

[21] Appl. No.: 643,437

[52] U.S. Cl. ..... 165/8; 165/10

[51] Int. Cl.[2] ..... F28D 19/04

[58] Field of Search ..... 165/8, 10

[56] References Cited

UNITED STATES PATENTS

| | | | |
|---|---|---|---|
| 2,896,920 | 7/1959 | Weller | 165/10 X |
| 3,314,472 | 4/1967 | Krumm et al. | 165/10 |
| 3,379,420 | 4/1968 | Woolard et al. | 165/10 |
| 3,605,874 | 9/1971 | Brunell | 165/10 X |
| 3,874,442 | 4/1975 | Johnsson | 165/10 |

FOREIGN PATENTS OR APPLICATIONS

| | | | |
|---|---|---|---|
| 684,797 | 12/1952 | United Kingdom | 165/10 |

*Primary Examiner*—Albert W. Davis, Jr.
*Attorney, Agent, or Firm*—Robert L. Olson

[57] ABSTRACT

A rotary regenerative air heater or heat exchanger in which a series of parallel adjacent plates contained in a plurality of sectorial baskets make up the heat transfer surface. A plurality of bolts permit quick and easy periodic tightening of the heating plates when they become loose within the basket, thereby preventing abrasion and vibratory failure of such plates.

4 Claims, 4 Drawing Figures

TIGHTENING OF HEATING ELEMENTS OF A REGENERATIVE AIR HEATER

BACKGROUND OF THE INVENTION

Air heaters of the rotary regenerative type includes a rotor which is mounted for rotation either about a horizontal axis or a vertical axis. The rotor is made up of a plurality of metal plates stacked tightly within a plurality of sector-shaped baskets. The air heater normally is used for extracting heat from exhaust gases leaving the furnace of a steam generaor, and transferring this heat to a stream of air used to support combustion of fuel within the furnace.

During operation, particularly when the axis of the rotor is positioned horizontally, problems are encountered due to corrosion and breakage of some of the heating plates, so that they become somewhat loose within the baskets. The plates then rub and slide against one another causing abrasive wear, which substantially reduces the life of such plates. One manner of solving this problem is to drive metal wedges between the plates within the basket to thereby tighten them. This is done during scheduled maintenance shutdowns of a unit.

The wedges add weight to the air heater, and also create unbalance of the rotor about its axis of rotation. Access to the inside of the air heater for permitting the wedges to be driven into place by an operator is also a costly and time consuming procedure, requiring partial disassembly of the air heater.

SUMMARY OF THE INVENTION

The air heater of the invention comprises a plurality of sectorshaped baskets each containing a plurality of parallel adjacent heating plates. Bolts having their adjustable ends positioned on the outside periphery of the rotor are threaded into the basket members with one end bearing against the heating plates so as to be adjustable to thereby tighten the heating plates when they become loose within the basket. The housing for the air heater contains a removable cover by means of which an operator can quickly and easily obtain access to the ends of the bolts when tightening is required.

DESCRIPTION OF THE PREFERRED EMBODIMENT

Figure 1:
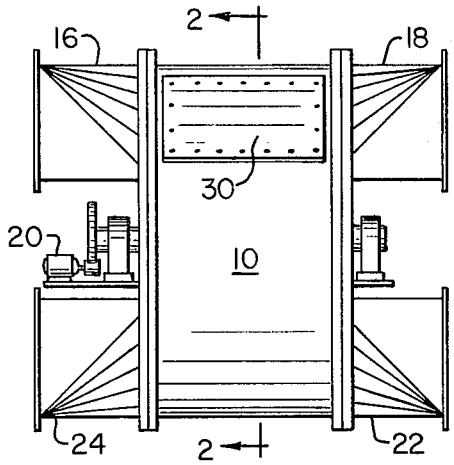
FIG. 1 is a sectional view of a rotary regenerative air heater embodying the invention.
Figure 2:
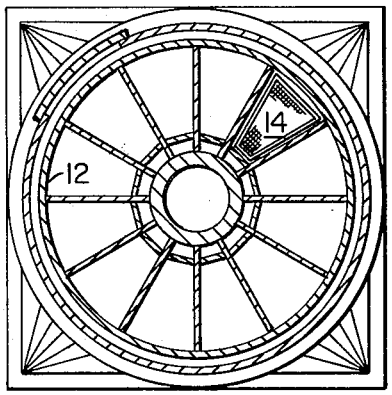
FIG. 2 is a view taken along lines 2—2 of FIG. 1.

As illustrated in FIGS. 1 and 2 of the drawing, the air heater comprises a housing 10 enclosing a rotor 12 containing a mass of heat exchange material 14 that is contacted by a stream of hot gases entering the housing through an inlet duct 16 and exhausted through an outlet duct 18 after having traversed the heat exchange material in the compartments therebetween. Cool air or other cool gas entering the housing through an inlet 22 is exhausted through an outlet duct 24 after having traversed the heat exchange material lying in the compartment therebetween. While the gases are being directed through their respective passageways the rotor 12 is being rotated about its axis by drive means 20 in order that each portion of heat exchange element contained therein may be alternately subjected to the hot and cool gas.

The heat exchange material carried by the rotor comprises a mass of heat absorbent plates 26 (FIG. 3) formed with projections that provide flow passageways therebetween for the flow of the hot and cool gases. The plates are assembled in an orderly array and positioned in a metallic basket that firmly holds the plates in a predetermined relationship in order that they may be easily handled as an integral element mass when arranged in the rotor of the air heater.

Figure 3:
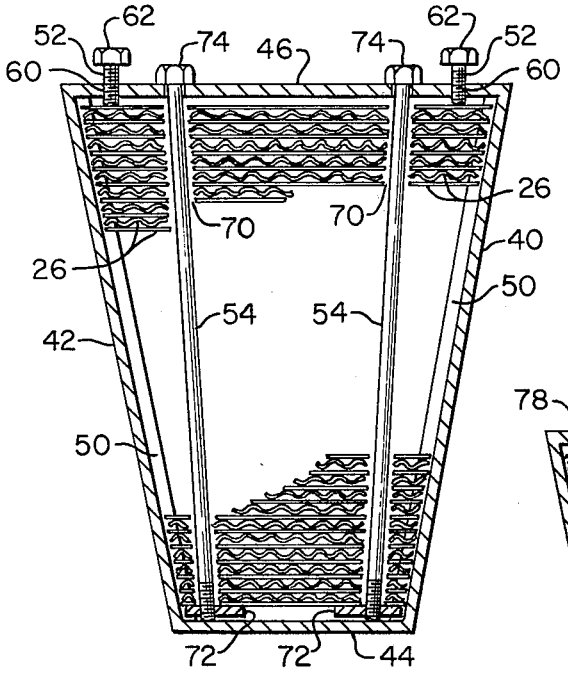
FIG. 3 is an enlarged sectional view of one of the baskets containing heating plates therein, along with tightening bolts constructed in accordance with the invention.

Looking now to FIG. 3, the construction of an individual sector-shaped basket can be seen. Each basket has a pair of side plates 40, 42, and an inner and outer plate 44, 46, respectively. These plates are secured together to form an integral basket. Each basket is filled with a plurality of heating plates 26 formed with projections that keep them slightly spaced when stacked together.

A pair of edge members 50 are secured to each edge of side plates 40, 42 after the heating plates have been positioned within the basket, to keep them from falling out. The means for tightening the heating plates together are a plurality of bolts 52 and 54. There are preferably four of each, one for each corner, although other numbers could be used. The bolts 52 are threaded into threaded holes 60 in the outer plate 46. A hexagonal head 62 on each bolt enables an operator to thread the bolts further into the basket when tightening of the plates is required. The other end of bolts 52 rest against the outermost heating plate 26. If the heating plates 26 are not made of sufficiently strong sheet metal to prevent buckling when the bolts 52 are tightened, then the outermost heating plate 26 should be made of oversized material. Since most air heaters are quite large in size, with end plates 44 and 46 being many feet apart, the bolts 54 are provided for applying a tightening force from the other end. Each of these bolts pass through holes 70 cut through each of the heating plates. A plate 72 is threaded onto one end of each bolt, and the other end of each bolt has a hexagonal head 74, by means of which the bolt can be rotated, causing the plates 72 to force the heating plates to be drawn closer together when tightening is necessary. If necessary, some indentation on the inner most plate 26 can be provided to prevent the plates 72 from rotating with the bolt 54.

As seen in FIG. 1, the housing 10 has a cover 30 which is removably secured thereto to provide an access opening. During a maintenance shutdown of the unit, an operator can gain quick and easy access to all of the tightening bolts by removing the cover 30, and rotating the air heater so as to bring each sector into alignment with the opening. Since all of the tightening bolts 52, 54 can be adjusted from the outer periphery of the rotor, no disassembly of the air heater is necessary for tightening of the heating elements other than removal of cover 30.

Figure 4:
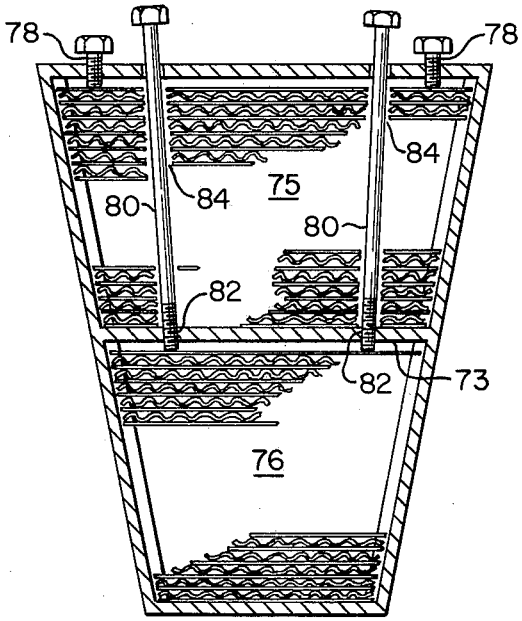
FIG. 4 is an enlarged sectional view of a different form of basket, along with a modified bolt arrangement for tightening of the heating plates.

FIG. 4 shows an alternative basket arrangement and bolt tightening arrangement. In this embodiment, the basket has a plate 73 dividing the basket into two compartments 75 and 76. Bolts 78 are used to tighten the heating plates in outer compartment 75 in the same manner as the bolts 52 of the FIG. 3 embodiment do. Bolts 80 are threaded into threaded holes 82 of divider plates 73, so that they can be threaded further into compartment 76 when tightening of these heating plates is necessary. The bolts 80 pass through holes 84 in the heating plates within outer compartment 75. It should be obvious that two or more divider plates 73 could be used to form three or more separate compartments within each basket. In this arrangement, tightening of all the bolts 78 and 80 can be accomplished from the outer periphery of the air heater, in the same manner as that of the FIG. 3 embodiment.

What is claimed is:

1. A rotary regenerative heat exchanger including a rotor, a substantially cylindrical, stationary housing enclosing the rotor, a central shaft around which the rotor rotates, means for rotating the rotor, said rotor including a plurality of sectorial baskets, each basket having a pair of side plates, an outer peripheral end plate, and an inner peripheral end plate, a plurality of separate, parallel, substantially flat heating plates stacked one adjacent the other so as to fill each basket, said heating plates being positioned so as to be parallel with the end plates, and bolt means secured to the outer peripheral plate of each basket, each bolt means having a portion coacting with the heating plates in such a manner that adjusting the bolt means causes the heating plates to be forced closer and tighter together.

2. A rotary regenerative heat exchanger as set forth in claim 1 including a removable cover on a portion of the housing, which cover when removed permits access to the bolt means from outside of the housing.

3. The rotary regenerative heat exchanger of claim 1 wherein the bolt means includes first bolts which are threaded through threaded openings in the outer peripheral plate, the first bolts having ends bearing against the outer most heating plate, said bolt means further including second bolts passing through openings in each of the heating plates, so that one end of each of the second bolts is positioned inwardly of the inner most heating plate, and a tightening member secured to the one end of each of the second bolts in such a manner so as to permit the second bolts to be adjusted from the outer peripheral end plate so as to exert a force against the inner most heating plate in a direction to cause tightening of the heating plates.

4. The rotary regenerative heat exchanger as set forth in claim 3, including a removable cover on a portion of the housing, which cover when removed permits access to the bolt means from outside of the housing.

* * * * *